United States Patent [19]

Garrett

[11] 4,317,522

[45] Mar. 2, 1982

[54] SUSPENDED PLATE DISPLAY SYSTEM

[76] Inventor: June P. Garrett, 3061 Southdale Dr., Dayton, Ohio 45409

[21] Appl. No.: 99,269

[22] Filed: Dec. 3, 1979

[51] Int. Cl.[3] ..... A47F 5/08

[52] U.S. Cl. ..... 211/113; 211/41

[58] Field of Search ..... 211/41, 113; 248/490, 248/491; 182/196, 199; 40/617; 108/28, 30, 149

[56] References Cited

U.S. PATENT DOCUMENTS 197,927 12/1877 Everitt ..... 182/196
574,584 1/1897 Staten ..... 40/617
727,170 5/1903 May ..... 182/199
2,614,778 10/1952 Graves ..... 248/490

*Primary Examiner*—Ernest R. Purser
*Attorney, Agent, or Firm*—Biebel, French & Nauman

[57] ABSTRACT

A plate display system is formed as a series of vertically spaced, chain-supported shelves which may be suspended from hooks secured in a ceiling or other overhead structure. Each of the shelves has hooks projecting from its lower surface which engage plate hangers secured to the plates being displayed to provide an attractive, but secure display system.

1 Claim, 4 Drawing Figures

SUSPENDED PLATE DISPLAY SYSTEM

BACKGROUND OF THE INVENTION

The collecting of attractive and unusual plates has been a popular hobby for many years. In addition to the pleasure of acquiring such plates the collector naturally desires to display them. Two primary concerns of the collector in displaying a plate collection is that the display system not only presents the plates attractively, but also provides a degree of security against accidental plate damage. Thus, although the collector usually desires to display the collection in a manner which best exhibits the plate's features, the monetary or sentimental value, or both, usually associated with such plates renders it imperative that the plates not be subjected to accidental damage.

Various plate racks have been made the subject of patents as typified by the 1917 patent to Brekke, U.S. Pat. No. 1,216,061, and the 1918 patent to Fischer, U.S. Pat. No. 1,253,950. Both of these patents disclose rigid plate racks having shelves on which the lower edges of the plates rest. Generally stops are provided in racks of this type to prevent the lower edges of the plates from slipping outwardly off the rack. Additionally, such racks are usually designed to be attached to a vertical wall surface. Aside from these limitations, racks of this type generally present a rather massive appearance which it is felt detracts from the effective display of the often relatively fragile plates being displayed.

A jewelry display rack is shown in U.S. Pat. No. 4,121,720 of 1978. In this rack a series of vertically spaced rings are interconnected by chains and are provided with hooks designed to support necklaces, bracelets and similar elongated, flexible pieces of jewelry. Obviously such racks are not suitable for the display of plates.

Additionally, a general purpose, cord-suspended shelf which utilize a hollow bead is disclosed in U.S. Pat. No. 3,901,165 of 1975. Again, while the shelf disclosed in this patent may be suitable for general purposes it would not provide the features needed for a secure yet effective plate display rack.

SUMMARY OF THE INVENTION

The plate display rack of the present invention provides a system for displaying often valuable plates in a safe, yet attractive manner.

In the display rack of the present invention the rack itself is comprised of a series of vertically spaced, narrow, horizontally extending shelves which are interconnected and suspended from an overhead support by means of chains or other relatively non-stretchable, flexible suspension means which presents a seemingly light, yet actually quite strong display medium. The stability of the structure is further enhanced by hollow beads through which the chains pass intermediate the shelves, which beads also improve the overall attractiveness of the unit. The plates themselves, rather than being precariously perched on their lower edges on the shelves are instead suspended from beneath the shelves in a manner which not only adds to the effectiveness of the display, but also provides a significant measure of increased security against plate damage.

In addition to these advantages, the display system possesses a degree of mobility not found in prior art display racks in that the display system of the present invention may be suspended from a ceiling or other overhead structure at any point desired by the collector, rather than being confined to areas adjacent vertically extending walls.

Thus, it will be seen that the display rack of the present invention provides a safe, yet visually effective display system which is not limited to attachment on or adjacent vertical walls.

DESCRIPTION OF THE PREFERRED EMBODIMENT

Figure 1:
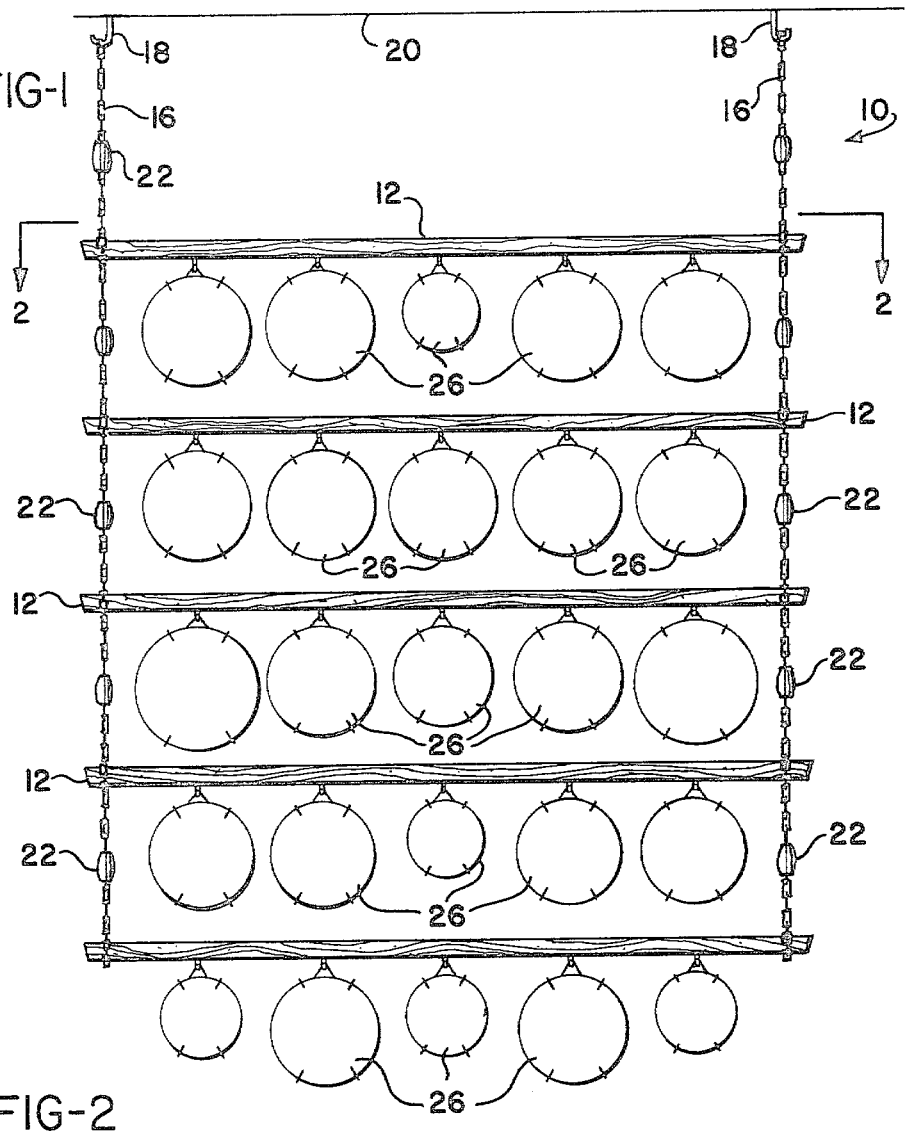
FIG. 1 is an elevational view showing the suspended plate rack of the present invention.
Figure 2:
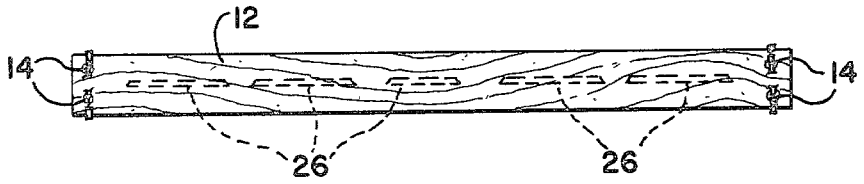
FIG. 2 is a view taken along line 2—2 of FIG. 1.
Figure 3:
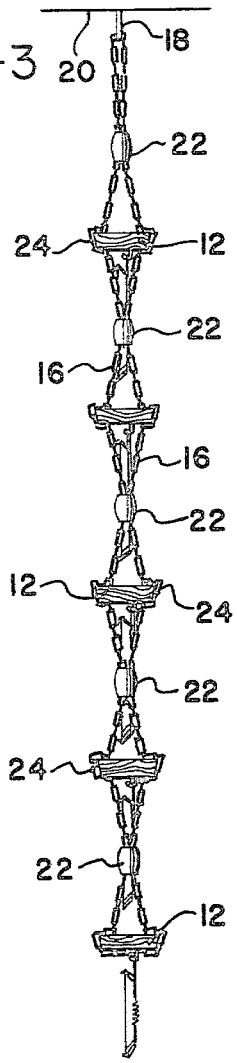
FIG. 3 is an end view of the plate rack of the present invention.

The plate rack 10 of the present invention comprises a series of elongated, narrow shelves 12, each of which is provided as seen in FIG. 2 with a pair of openings 14 through which chains 16 extend. Each of the chains comprises a double length which may be looped over a hook or other supporting member 18 projecting from a ceiling or other overhead structure 20. The double lengths of chain then extend downwardly though hollow beads 22, thence through the openings 14 and are looped, as indicated at 24, around the opposite longitudinal edges of the shelves and then back through the openings 14. The free ends of the chains may then be secured in any suitable fashion, such as by nailing or stapling, to the lower surface of the lowermost shelf.

Figure 4:
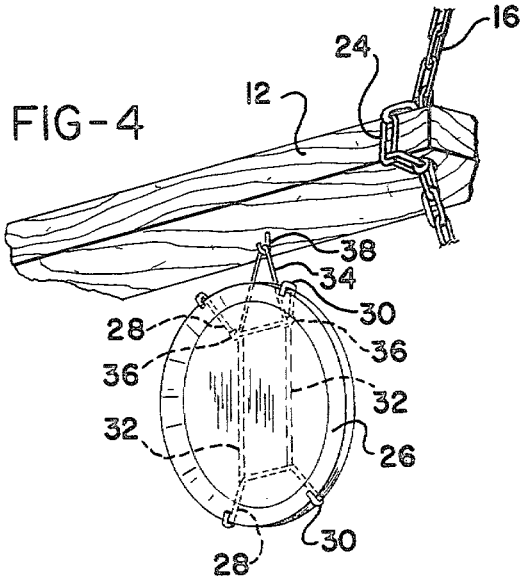
FIG. 4 is a partial perspective view illustrating in greater detail a portion of the rack of the present invention.

Each of the plates 26 as best seen in FIG. 4 of the drawings is provided with a hanger of any suitable type, that illustrated in FIG. 4 comprising a pair of substantially U-shaped wire members 28 having hooks 30 which grip the edges of the plate and are interconnected with springs 32 to hold the hanger securely on the plate. A substantially V-shaped member 34 having hooked ends 36 engages the uppermost member 26 and provides an anchor for attachment to a hook 38 projecting from a lower surface of the shelf. Thus, rather than the plates resting on their lower edges on the shelves, from which position they could be easily dislodged, they are instead suspended securely from beneath each of the shelves, not only increasing the security with which the plates may be displayed, but also vastly increasing the aesthetic effectiveness of the display system.

While the form of apparatus herein described constitutes a preferred embodiment of the invention, it is to be understood that the invention is not limited to this precise form of apparatus, and that changes may be made therein without departing from the scope of the invention.

What is claimed is:

1. In combination with a plurality of individual plates each having individual plate hangers attached thereto to hanging said plates in vertically spaced, horizontal rows of plates for display purposes, a suspended plate display system comprising:

a plurality of elongated, narrow shelves, said shelves being disposed in vertically spaced, substantially parallel, horizontal planes, pairs of openings formed in opposite ends of each of said shelves, double lengths of chains extending through said pairs of openings, looped around opposite longitudinal edges of said shelves and back through said openings to fix and suspend said shelves in said spaced parallel relationship to each other.

hollow beads positioned between adjacent shelves, said double lengths of chains passing through said hollow beads whereby said double lengths of chains are drawn together by said hollow beads intermediate said adjacent shelves to enhance the stability of said system, and a plurality of hooks projecting from lower surfaces of said shelves, each of said hooks engaging an individual one of said plate hangers and hanging a plurality of said plates beneath each of said shelves for displaying said plates as horizontally arranged vertically spaced rows of plates.

* * * * *